US008542801B2

(12) United States Patent
Westcot et al.

(10) Patent No.: US 8,542,801 B2
(45) Date of Patent: Sep. 24, 2013

(54) X-RAY TUBE WITH SECONDARY DISCHARGE ATTENUATION

(75) Inventors: Ethan James Westcot, Milwaukee, WI (US); Thomas Dean Schaefer, Milwaukee, WI (US); Kalyan Koppisetty, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 442 days.

(21) Appl. No.: 12/986,931

(22) Filed: Jan. 7, 2011

(65) Prior Publication Data

US 2012/0177186 A1 Jul. 12, 2012

(51) Int. Cl.
*H05G 1/52* (2006.01)

(52) U.S. Cl.
USPC ..... 378/137; 378/113; 378/138

(58) Field of Classification Search
USPC ..... 378/91, 113, 136–138, 204, 210
See application file for complete search history.

(56) References Cited

U.S. PATENT DOCUMENTS 5,908,884 A * 6/1999 Kawamura et al. ..... 523/136
7,289,603 B2 * 10/2007 Andrews et al. ..... 378/138
7,839,979 B2 * 11/2010 Hauttmann et al. ..... 378/137

* cited by examiner

*Primary Examiner* — Anastasia Midkiff
(74) *Attorney, Agent, or Firm* — Fletcher Yoder, PC

(57) ABSTRACT

The present embodiments relate to off-focal X-ray radiation attenuation within X-ray tubes, for example X-ray tubes used in CT imaging. In one embodiment, an X-ray tube for off-focal X-ray radiation attenuation is provided. The X-ray tube includes a cathode, a target, and a magnetic focal spot control unit having at least one electromagnet encased in a resin loaded with X-ray attenuating material.

25 Claims, 3 Drawing Sheets

X-RAY TUBE WITH SECONDARY DISCHARGE ATTENUATION

BACKGROUND OF THE INVENTION

The subject matter disclosed herein relates to X-ray tubes and, in particular, to attenuation features for secondary discharges of X-rays within an X-ray tube.

In non-invasive imaging systems, X-ray tubes are used in fluoroscopy, projection X-ray, tomosynthesis, and computer tomography (CT) systems as a source of X-ray radiation. Typically, the X-ray tube includes a cathode and a target. A thermionic filament within the cathode emits a stream of electrons towards the target in response to heat resulting from an applied electrical current, with the electrons eventually impacting the target. Once the target is bombarded with the stream of electrons, it produces focal and off-focal X-ray radiation.

The focal X-ray radiation traverses a subject of interest, such as a human patient, and a portion of the radiation impacts a detector or photographic plate where the image data is collected. Generally, tissues that differentially absorb or attenuate the flow of X-ray photons through the subject of interest produce contrast in a resulting image. In some X-ray systems, the photographic plate is then developed to produce an image which may be used by a radiologist or attending physician for diagnostic purposes. In digital X-ray systems, a digital detector produces signals representative of the received X-ray radiation that impacts discrete pixel regions of a detector surface. The signals may then be processed to generate an image that may be displayed for review. In CT systems, a detector array, including a series of detector elements, produces similar signals through various positions as a gantry is displaced around a patient.

Despite the electron stream colliding with the target in the proper location, some X-rays do not exit through the window, but instead are projected back through the X-ray tube, and may result in secondary radiation. This off-focal X-ray radiation generated in the X-ray tube must be contained within the unit so that the X-rays do not exit to the environment. Traditionally, X-ray attenuation has been provided through the use of lead linings placed along the outer periphery of the tube unit. Environmental awareness and regulation has made these techniques less desirable. Furthermore, full enclosure shielding can be bulky, requiring a large amount of shielding material. Accordingly, a need exists from improved off-focal X-ray shielding in X-ray tubes.

BRIEF DESCRIPTION OF THE INVENTION

In one embodiment, an X-ray tube is provided. The X-ray tube includes a cathode configured to output an electron beam and a target configured to receive the electron beam and to generate X-rays. Additionally, the X-ray tube includes a magnetic focal spot control unit disposed between the cathode and the target. The magnetic focal spot control unit may generate electromagnetic fields to affect the electron beam. The magnetic focal spot control unit includes at least one electromagnet encased in a resin loaded with an X-ray attenuating material.

In another embodiment, an electromagnet for an X-ray tube is provided. The electromagnet includes an electromagnet assembly for a magnetic focal spot control unit designed to be disposed between a cathode and a target of an X-ray tube. The electromagnet assembly may generate electromagnetic fields to affect the electron beam. Additionally, the electromagnet is encased in a resin loaded with an X-ray attenuating material.

In a further embodiment, a method of forming an electromagnet is provided. The method generally includes doping a resin with an X-ray attenuating material, winding a coil around a magnet core, and encasing the magnet core and the coil in the loaded resin.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present approach is directed towards a system and method for attenuating off-focal X-rays produced in an X-ray tube. For example, in embodiments of an X-ray tube wherein a magnetic focal spot control unit is present, attenuation materials surrounding the electromagnets within the magnetic focal spot control unit may provide the attenuation desired to contain the off focal, or secondary, X-rays.

Figure 1:
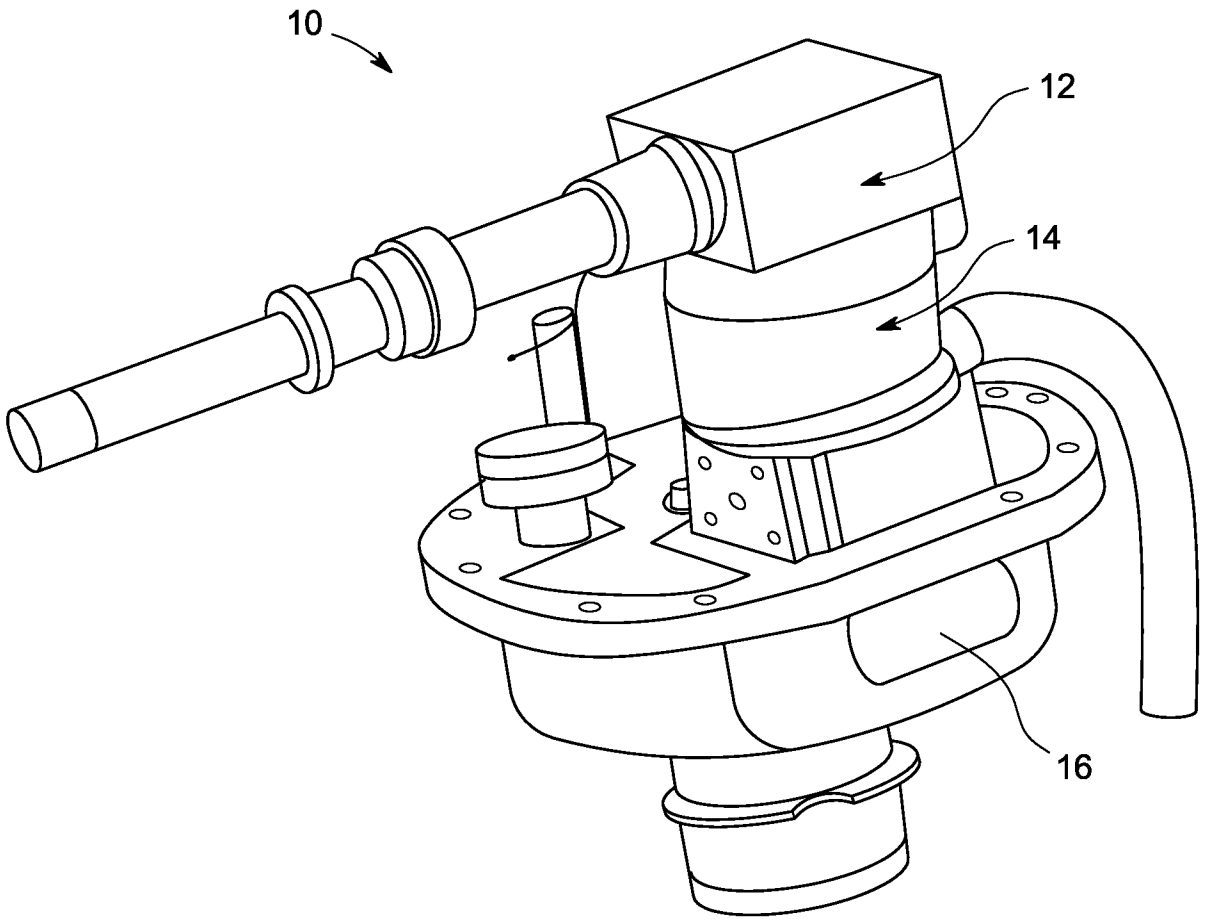
FIG. 1 is a perspective view of an X-ray tube, in accordance with present embodiments of the invention.

The secondary discharge attenuation techniques discussed herein may be utilized in an X-ray tube, such as X-ray tubes utilized in projection X-ray imaging systems, fluoroscopy imaging systems, CT imaging systems, and so on. FIG. 1 illustrates such an X-ray tube 10 for obtaining X-rays useful for imaging systems designed to acquire X-ray data, to reconstruct an image based upon the data, and to process the image data for display and analysis.

In the embodiment illustrated in FIG. 1, the X-ray tube 10 includes a cathode assembly 12. The cathode assembly 12 accelerates a stream of electrons through the X-ray tube 10, including through the magnetic focal spot control unit 14, designed to control steering and size of the electron stream. The magnetic focal spot control unit may comprise two subassemblies with multiple quadrupole and dipole magnets configured to provide steering and wobble abilities for the stream of electrons. As a result of a collision of the electrons within the X-ray tube 10, X-rays are produced. Focal X-ray radiation is emitted through the window 16, where it may be useful in obtaining X-ray imaging data. The electron stream collision within the X-ray tube 10 may also result in off-focal X-ray radiation occurring within the X-ray tube. In an effort to decrease exposure to unnecessary radiation by the X-ray system operator and to decrease interference with the X-ray imaging system using the focal X-ray radiation, the off-focal X-ray radiation must be contained within the X-ray tube 10.

Figure 2:
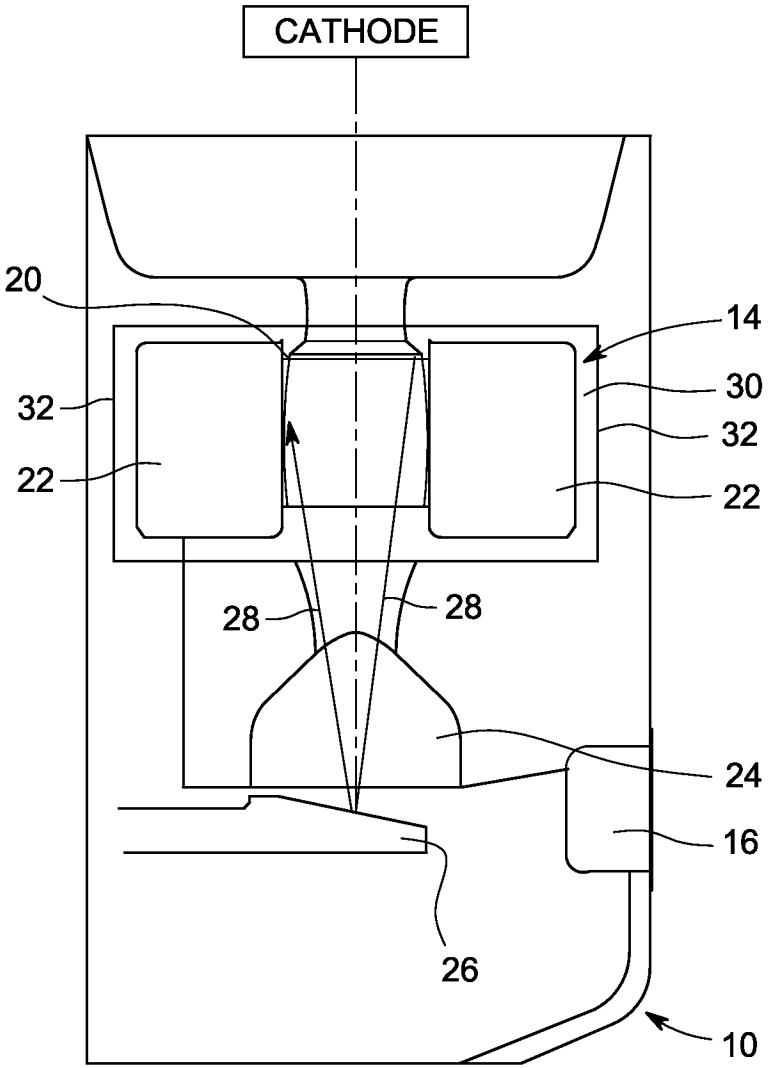
FIG. 2 is a cross-sectional side view of a portion of the X-ray tube depicted in FIG. 1.

As noted above, the present embodiments are directed towards attenuation of the off-focal X-ray radiation produced within the X-ray tube 10. In accordance with the embodiments disclosed herein, attenuation may be performed by placing attenuation materials within the magnetic focal spot control unit 14. FIG. 2 depicts a cross-sectional view of the X-ray tube embodiment of FIG. 1 to more clearly explain the current techniques. As previously discussed, cathode assembly 12 may accelerate an electron stream 18 through a common bore in the X-ray tube 10. The electron stream 18 may pass through a throat 20 of the magnetic focal spot control unit 14. As the electron stream 18 passes through the throat 20, the magnetic focal spot control unit 14 may provide electromagnetic fields through electromagnets 22, controlling the size and position of electron stream 18. Thus, the magnetic focal spot control unit 14 provides for steering of the electron stream as well as the ability to quickly change the position of the electron stream, such as for wobble. The electromagnets 22 may include a resin encasement, which creates a path around the throat 20 of the magnetic focal spot control unit 14 as well as provides mechanical integrity to the magnet assembly. Additionally, as will be described in more detail below, the resin may be configured to provide X-ray attenuation characteristics within the X-ray tube 10. Next, the electron stream may pass through an electron collector 24 and collide with a target 26. The collision of the electron stream 18 with the target may result in electrons bouncing back into the X-ray tube. As illustrated, the electron collector 24 may be disposed in facing relation to the target 26, allowing the electron collector 24 to capture and contain electrons that bounce from the target 26 back into the electron collector 24. Additionally, the collision may produce resultant X-ray radiation. Focal X-ray radiation is produced and emitted through the window 16. Off-focal X-ray radiation 28 may be directed inward, back through the X-ray tube 10, reaching the magnetic focal spot control unit 14. As will be discussed in more detail below, the electromagnets 22 within the magnetic focal spot control unit 14 may be configured to attenuate the off-focal X-ray radiation, so that the X-ray radiation does not pass through a support base 30, and more specifically through external surfaces 32 of the support base 30.

Figure 3:
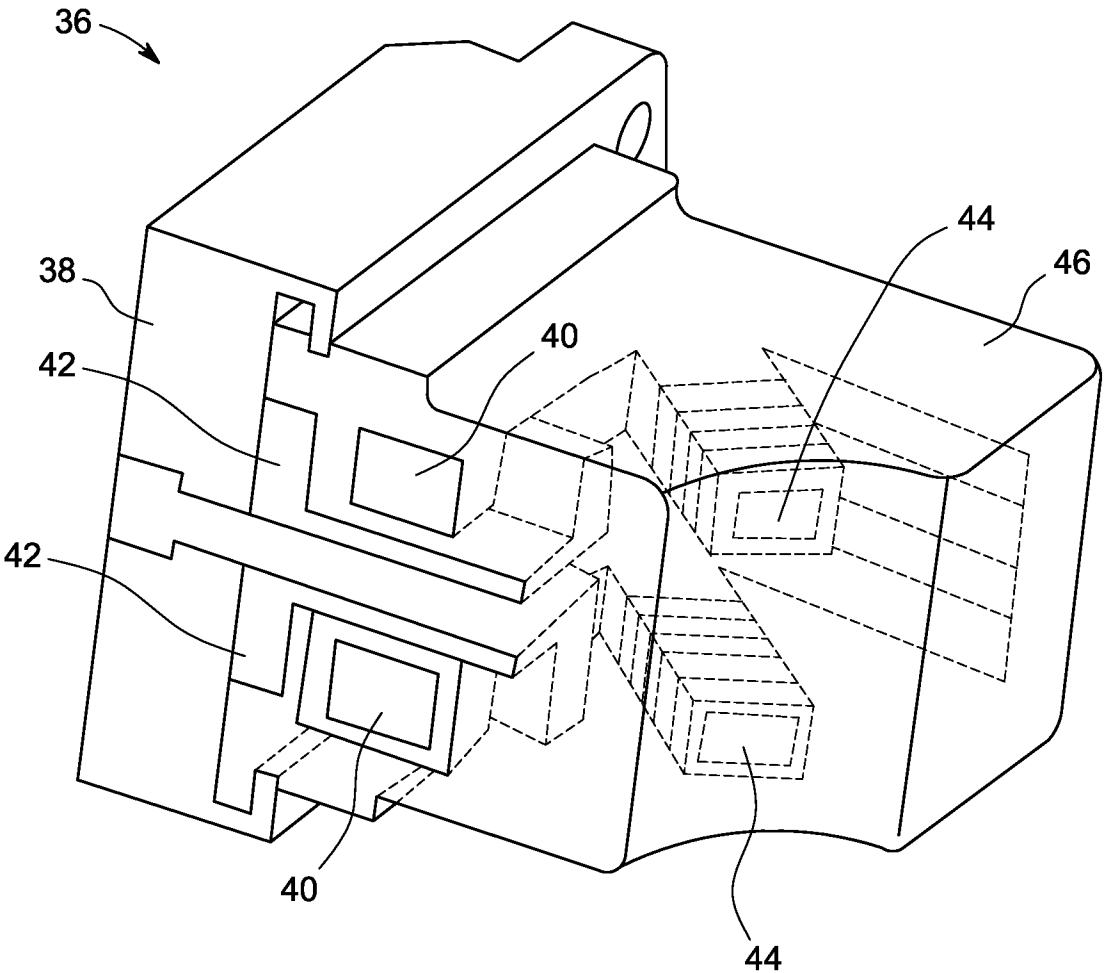
FIG. 3 is a perspective view of a part of the magnet assembly, depicting various features of the electromagnet.

In some embodiments, the electromagnets 22 within the magnetic focal spot control unit 14 may be formed into a magnet assembly. FIG. 3 illustrates a partial cross-sectional view of one embodiment of a magnet assembly 36, which may be incorporated into the magnetic focal spot control unit 14. FIG. 3 depicts one half of an electromagnet 22. In some embodiments, the magnet assembly 36 may include a pair of substantially identical electromagnets 22. The magnet assembly 36 may include a frame 38, capable of uniting the various elements of the magnet assembly 36. As is commonly found in electromagnets, the magnet assembly 36 may contain magnet cores 40. The magnetic cores 40 may be contained within the magnet assembly 36 by resting on nests 42. Windings 44 may surround the magnetic cores 40 in various locations of the core. As electrical current flows through the windings 44, the cores 40 become magnetic and an electromagnetic field is formed.

As previously discussed, the electromagnets within the electromagnetic focal spot control unit 14 may attenuate the off-focal X-ray radiation 28. Providing attenuation within the magnetic focal spot control unit 14 may provide more efficient X-ray shielding than shielding external to the X-ray tube, by attenuating the off-focal X-rays at a sight of greater flux. The attenuation features of the electromagnets 22 and ultimately the electromagnet assembly 36 may be achieved by providing a resin encasement for the electromagnets 22, where the resin 46 is loaded with X-ray attenuating materials. The X-ray attenuating materials incorporated into the resin 46 may consist of high-density, non-magnetic materials that have a low magnetic permeability. Additionally, it may be desirable that the attenuating materials have little to no electrical conductance, as conductive materials may affect the electromagnetic field generated by the electromagnets 22. For example, tungsten, while high density and capable of X-ray attenuation, is also conductive and thus may interfere with the electromagnetic field produced by the electromagnets 22. Examples of a few suitable attenuating materials may include bismuth oxide, lead oxide, or barium sulfate. The ratio of resin 46 to attenuating materials may affect the attenuation characteristics of the electromagnets 22. Increasing the percent by volume of attenuating materials may increase the attenuation capabilities of the resin. Furthermore, the percent by volume of attenuating materials may be controlled based upon the desired thickness of the resin 46 loaded with the attenuating material or based upon the amount of attenuation desired by the encased electromagnets 22. For example, in one embodiment, the resin may have a thickness of 9 mm. At a 9 mm thickness level, to obtain full attenuation, it may beneficial for the resin 46 to contain at least approximately 50% bismuth oxide by volume. The percent by volume may be reduced if full attenuation is not required. For example, if full attenuation is not necessary, the amount of bismuth oxide may be reduced to approximately 40% by volume, providing approximately 99% attenuation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube, comprising:

a cathode configured to output an electron beam;

a target configured to receive the electron beam and to generate X-rays;

magnetic focal spot control unit disposed between the cathode and the target and configured to generate electromagnetic fields to affect the electron beam, the magnetic focal spot control unit comprising at least one electromagnet encased in a resin loaded with an X-ray attenuating material.

2. The X-ray tube of claim 1, comprising an electron collector disposed in facing relation to the target and between the magnetic focal spot control unit and the target.

3. The X-ray tube of claim 2, wherein the magnetic focal spot control unit and the electron collector define a common bore through which the electron beam passes during operation.

4. The X-ray tube of claim 3, wherein the resin loaded with the X-ray attenuating material presents a thickness of at least approximately 9 mm through which X-rays must pass to exit the X-ray tube.

5. The X-ray tube of claim 1, wherein the X-ray attenuating material comprises a high-density, non-magnetic material.

6. The X-ray tube of claim 1, wherein the X-ray attenuating material comprises bismuth oxide.

7. The X-ray tube of claim 6, wherein the resin is doped with at least approximately 40% bismuth oxide by volume.

8. The X-ray tube of claim 6, wherein the resin is doped with at least approximately 50% bismuth oxide by volume.

9. The X-ray tube of claim 1, wherein the X-ray attenuating material comprises lead oxide.

10. The X-ray tube of claim 1, wherein the X-ray attenuating material comprises barium sulfate.

11. The X-ray tube of claim 1, wherein the magnetic focal spot control unit comprises a pair of substantially identical electromagnets.

12. An electromagnet for an X-ray tube, comprising:

an electromagnet assembly for a magnetic focal spot control unit configured to be disposed between a cathode and a target of an X-ray tube and configured to generate electromagnetic fields to affect the electron beam, the electromagnet being encased in a resin loaded with an X-ray attenuating material.

13. The electromagnet of claim 12, wherein the X-ray attenuating material comprises a high-density, non-magnetic material.

14. The electromagnet of claim 12, wherein the X-ray attenuating material comprises bismuth oxide, lead oxide, and/or barium sulfate.

15. The electromagnet of claim 12, wherein the resin is doped with at least approximately 40% bismuth oxide by volume.

16. A method of forming an electromagnet, comprising:

doping a resin with an X-ray attenuating material;

winding a coil around a magnet core; and encasing the magnet core and the coil in the loaded resin.

17. The method of claim 16, wherein the X-ray attenuating material comprises a high-density, non-magnetic material.

18. The method of claim 17, wherein the X-ray attenuating material comprises bismuth oxide.

19. The method of claim 17, wherein the resin is doped with at least approximately 40% bismuth oxide by volume.

20. The method of claim 16, wherein the resin is doped with at least approximately 50% bismuth oxide by volume.

21. The method of claim 16, wherein the X-ray attenuating material comprises lead oxide.

22. The method of claim 16, wherein the X-ray attenuating material comprises barium sulfate.

23. The method of claim 16, wherein the magnet core and coil are encased in the loaded resin with a thickness of at least approximately 9 mm.

24. The method of claim 16, comprising adjusting the amount of attenuating material loaded into the resin based upon a desired level of X-ray attenuation.

25. The method of claim 16, comprising adjusting the amount of attenuating material loaded into the resin based upon a desired thickness of the resin.

* * * * *